United States Patent [19]

Burkhardt et al.

[11] Patent Number: 4,691,947

[45] Date of Patent: Sep. 8, 1987

[54] YARN TEXTURING NOZZLE

[75] Inventors: Klaus Burkhardt, Schwelm; Klaus Gerhards; Manfred Greb, both of Hückeswagen; Rainer Keuth; Erich Lenk, both of Remscheid, all of Fed. Rep. of Germany

[73] Assignee: Barmag AG, Remscheid, Fed. Rep. of Germany

[21] Appl. No.: 821,260

[22] Filed: Jan. 21, 1986

[30] Foreign Application Priority Data

Jan. 19, 1985 [DE] Fed. Rep. of Germany ..... 3501662
Mar. 15, 1985 [DE] Fed. Rep. of Germany ..... 3509323

[51] Int. Cl.[4] ..... D02G 1/12; D02G 1/16
[52] U.S. Cl. ..... 28/255; 28/272
[58] Field of Search ..... 28/255, 256, 272

[56] References Cited

U.S. PATENT DOCUMENTS 2,938,257 5/1960 Bauer .
3,199,339 8/1965 Lipski .
3,373,470 3/1968 Joly .
3,482,294 12/1969 Joly .
3,828,404 8/1974 Peckinpaugh et al. .
3,854,177 12/1974 Breen et al. .
3,875,625 4/1975 Blanc et al. .
3,958,310 5/1976 Blanc et al. .
4,416,041 11/1983 Gujer et al. .
4,453,298 6/1984 Nabulon et al. .
4,519,115 5/1985 Gujer et al. .
4,563,799 1/1986 Dammann .

FOREIGN PATENT DOCUMENTS 0026360 4/1981 European Pat. Off. .
0065726 12/1982 European Pat. Off. .
0108205 5/1984 European Pat. Off. .
0110359 6/1984 European Pat. Off. .
0123072 10/1984 European Pat. Off. .
2632083 1/1978 Fed. Rep. of Germany .
7723587 1/1979 Fed. Rep. of Germany .
2840177 3/1980 Fed. Rep. of Germany .
54-2450 1/1979 Japan ..... 28/255
872234 7/1961 United Kingdom .

*Primary Examiner*—Robert R. Mackey
*Attorney, Agent, or Firm*—Bell, Seltzer, Park & Gibson

[57] ABSTRACT

A yarn texturing nozzle is disclosed which comprises a yarn feeding inlet portion wherein a yarn is subjected to a heated and pressurized treatment fluid to heat the yarn and also advance the yarn therethrough. The nozzle also includes a stuffer box located downstream of the inlet portion. The inlet portion comprises a rectangular block which is divided into two parts along a plane extending coaxially through the yarn passageway to facilitate yarn threadup, and the stuffer box includes a slot through the side wall thereof which further facilitates yarn threadup.

22 Claims, 8 Drawing Figures

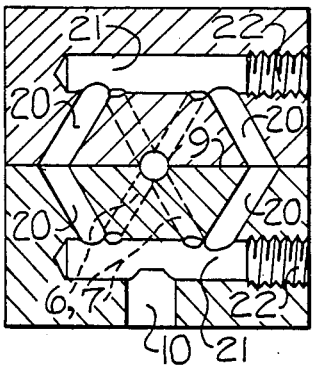
Fig-3A
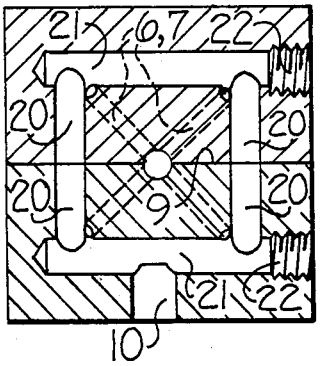
Fig-3B
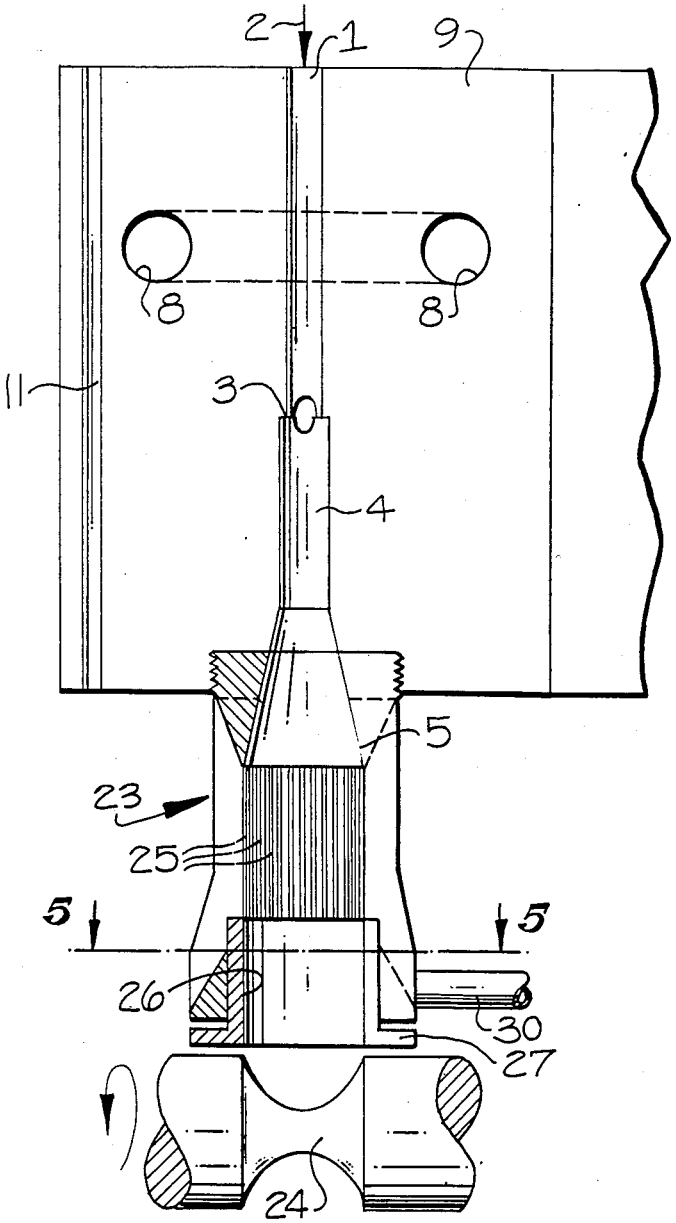
Fig-4
Fig-5
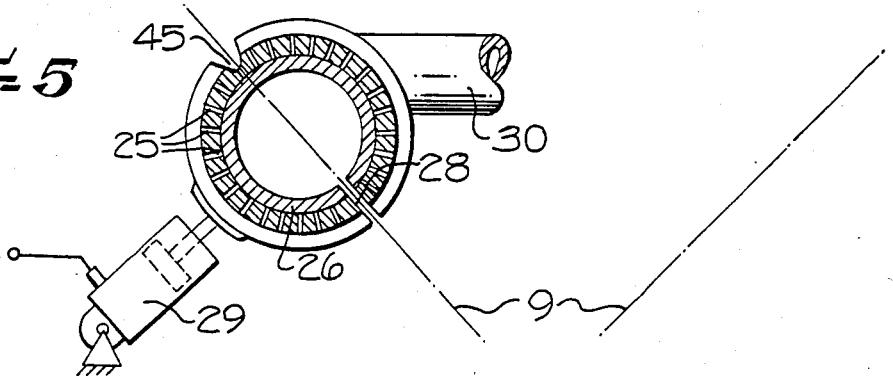

YARN TEXTURING NOZZLE

BACKGROUND OF THE INVENTION

The present invention relates to a yarn texturizing nozzle of the type which includes an inlet portion where the yarn is subjected to a jet of heated treatment fluid which serves to heat the yarn and advance the yarn into a stuffer box which is mounted immediately downstream of the inlet portion.

In the production of man made fibers at high operating speeds of, for example, 2,000 m/min and above, the threading of the yarn into an advance and texturizing nozzle of the described type presents a significant problem, and it is conventional to draw the yarn into the nozzle by a suction gun, which is time consuming and requires special equipment. As a result, various attempts have been made to simplify and shorten the time of the threading operation, as illustrated for example from U.S. Pat. No. 4,416,041 and published EPO Application No. 0065726.

The methods and apparatus described in the above prior art references relate to threading nozzles wherein a yarn or an auxiliary yarn is sucked into a nozzle. In methods and apparatus operating at very high yarn speeds, such sucking of the yarn into the nozzle is not possible, inasmuch as the nozzle geometry does not permit suction currents at high speeds. In addition, nozzles have previously been constructed which are divided along an axial plane of the yarn passage, so that the advancing yarn can be threaded into the nozzle in a direction transverse to its advance, note for example U.S. Patent No. 3,854,177. However, this prior construction has impaired the geometry of the yarn passage and the conduit for the treatment fluid, and as a result less than satisfactory texturizing results are achieved.

Other nozzles which can be opened by a hinged construction are illustrated in British Pat. No. 872,234 and U.S. Pat. Nos. 2,938,257 and 3,199,339. These nozzles are directed to the formation of loops and bows in the yarn so as to increase its bulk.

Finally, U.S. Pat. No. 4,453,298 illustrates a texturizing nozzle having a texturizing chamber which includes an annular conduit surrounding the yarn passage, and which includes several ducts which are inclined at an acute angle with respect to the yarn passageway, and which communicate with the yarn passageway in a mixing chamber. This nozzle is divided along an axial plane, and can be opened for laterally inserting the yarn into the yarn passageway. A disadvantage in this nozzle construction resides in the fact that the annular conduit is formed into the circumference of an inserted body, which must similarly be divided along an axial plane for the purpose of opening the nozzle, and which requires a high degree of accuracy in the manufacture of the inserted body, and a precisely fitting attachment of the two halves of the inserted body to the corresponding parts of the nozzle block.

It is an object of the present invention to provide a yarn texturizing nozzle which avoids the above noted disadvantages of the prior art, and which provides for the simple and rapid threadup of the yarn into the nozzle without impairing its efficiency. It is also an object of the present invention to provide a yarn texturizing nozzle of the described type wherein the heated treatment fluid enters into the yarn passageway from an annular distributor duct without using an inserted body which is divided in an axial plane.

It is a further object of the present invention to provide an optimum design for the inlet portion of a texturizing nozzle as well as the stuffer box portion, and which represents an improvement of texturizing nozzles shown in published European Patent Application Nos. 108,205, 123,072, 26,360, and 110,359. The texturizing nozzles illustrated in these applications consist of two halves which are tightly held against each other during operation. It is therefore necessary that the texturizing nozzles have the same rigidity over their entire length. This is in contrast to the necessity to provide the stuffer box with slots, holes or similar openings by which the heated treatment fluid may escape from the stuffer box without undue hinderance or throttling.

SUMMARY OF THE INVENTION

These and other objects and advantages of the present invention are achieved by the provision of a yarn texturizing nozzle which comprises a yarn feeding inlet portion which comprises a block having a yarn passageway extending therethrough and defining an inlet end and an outlet end. The block is divided into two parts along a plane extending axially along the passageway, so that the two parts may be separated along the plane to facilitate yarn threadup. The block further includes an internal duct communicating with the passageway and which is inclined with respect to the axis of the passageway so as to be directed toward the outlet end. Further, conduit means for connecting the internal duct to a source of pressurized treatment fluid is provided, and such that the pressurized fluid entering the passageway through the internal duct is adapted to feed a yarn through the passageway and toward the outlet end. A tubular stuffer box is mounted in coaxial communication with the outlet end of the passageway, and the stuffer box includes a peripheral side wall having opening means extending therethrough for permitting the treatment fluid to exhaust laterally through the side wall. Also, the stuffer box includes a yarn inserting slot extending through the side wall to facilitate yarn threadup.

The texturizing nozzle of the present invention thus consists of an inlet portion wherein the yarn is adapted to be impinged with a jet of hot treatment fluid or the like and advanced into the downstream stuffer box. The inlet portion and the stuffer box are mechanically separate units, which pneumatically communicate with each other. Only the inlet portion is divided into two parts, with one part being stationary and the other part being movable, and so that the yarn passage is formed and closed by a relative movement of the two parts. The stuffer box is a tube having a longitudinal yarn inserting slot in its wall which preferably is in alignment with the separating plane between the stationary and movable parts of the inlet portion.

The present invention takes into consideration the fact that a high heat energy as well as a high dynamic energy must be imparted to the yarn by impinging the yarn with a high velocity, heated treatment fluid. Therefore, any leakage of the heated fluid which is under considerable pressure, must be avoided. For the stuffer box however, the present invention provides a design which facilitates the escape of the heated fluid. Therefore, the stuffer box preferably comprises a relatively thin walled tube which has a relatively low rigidity.

The inlet portion on the other hand comprises a rather massive block, with the two divided parts thereof having congruent overlying surfaces. Also, these mating surfaces form the yarn passageway therebetween. The two block parts are connected by a hinge, and are pressed against each other by a biasing force during operation. Further, the nozzle of the present invention is characterized by a combination of novel features relating to the conduit for the pressurized treatment fluid. Specifically, the conduit system includes an annular internal conduit surrounding the yarn passageway when viewed in a plane transverse to the axis of the passageway, and at least one and preferably three or four individual internal ducts extend from the annular conduit to the yarn passageway. The annular conduit comprises a conduit segment within each of the two parts of the block, and such that the two conduit segments communicate with each other at the separating plane of the block. Each conduit segment may comprise a pair of passage bores extending from the separating plane on opposite sides of the yarn passageway, and with the two passage bores either communicating with each other at their inner ends, or being joined by additional connecting bores which are positioned in the same plane. As a result, a polygonal, annular conduit is formed which extends around the yarn passageway, and which in turn may be connected to a supply duct for the treatment fluid.

The internal ducts which extend between the annular conduit and the yarn passageway are correspondingly inclined, and are positioned on the straight surface of a cone. In addition, the yarn passageway through the block preferably includes a first portion adjacent the inlet end of relatively small diameter, and a second portion adjacent the outlet end of a larger diameter so as to define a shoulder at the juncture thereof. The internal duct preferably communicate with the passageway at the shoulder.

The present invention may also be embodied in a nozzle adapted to separately process two advancing yarns. In this embodiment, the block is of rectangular cross section and is divided along two mutually perpendicular planes which extend coaxially along each of two passageways, to thereby form three block parts which are triangular in cross section, and including a central part and two outer parts. The two outer parts are mounted to the central part to permit each of the outer parts to be separated from the central part along the associated separating plane, to facilitate yarn threadup. In addition, a tubular stuffer box is mounted to the block in coaxial communication with the outlet end of each of the passageways.

In the above embodiment, the central block part is in the form of a triangle, the cross section of which forms an isosceles, and preferably a right angled isosceles triangle. The two outer parts also each define a right angled isosceles triangle in cross section, with the mating congruent surfaces containing the yarn passageway. The two outer parts are movable with respect to the central part, perpendicularly to the separating plane and preferably being pivotally connected by means of a hinge. A hinge which provides for a particularly tight contact of the two mating surfaces of each nozzle may be formed by providing opposing parallel grooves along the separating plane in each of the mating parts, and which define a bore parallel to the yarn passageway. A rod may then be mounted within the grooves so that the two parts pivot about the axis of the rod. A slight chamfer of about 10–30 degrees, and preferably 10–20 degrees, may be provided at the edge of the separating surface of one nozzle part along the hinge bore, so as to provide clearance for the nozzle to be opened to a small angle. The advancing yarn may then be inserted or sucked into the yarn passageway in a lateral direction and without the need to cut the yarn.

In the above embodiment, each stuffer box may be connected to the yarn passageway and is preferably joined to the stationary central part of the block by a flanged or threaded connection. Each stuffer box is provided with axial slots for the exhaust of the treatment fluid, and each box also includes a yarn threading slot which extends over the entire length of the stuffer box and which is preferably located in the separating plane of the nozzle parts. Also, the threading slot is preferably kept closed by a mechanical or hydraulic contact pressure during the normal texturizing operation. For the purpose of inserting a yarn, the contact pressure means is released, so that the flexible wall of the stuffer box springs back to open the threading slot.

An insulating jacket preferably surrounds the nozzle of the present invention. Thus the nozzle will not appreciably cool, even during the threadup operation. In a preferred embodiment, the insulating jacket has one or more doors on its front side, with the doors being connected to the movable part of the nozzle so that the nozzle is simultaneously opened and closed together with the doors of the insulating jacket. The interior of the insulating jacket may be heated by suitable means.

To generate a contact pressure between the parts of the block, a servo assisted biasing means operated by pneumatic or hydraulic pressure may be provided. Means may also be provided to terminate the supply of the pressurized treatment fluid when the door is opened, or to reduce the flow to a very low rate. This may be provided for example by a valve positioned in the fluid supply line, so that the fluid is directed through a bypass having an adjustable pressure reducer, before proceeding to the annular interior conduct. The advantage of this arrangement is that while the yarn is being threaded or the nozzle is being cleaned, the nozzle block cools only a relatively small amount by reason of the heating effect of the fluid, and upon closing the door, the nozzle is immediately ready for operation.

BRIEF DESCRIPTION OF THE DRAWINGS

Some of the objects and advantages of the present invention having been stated, others will appear as the description proceeds, when taken in conjunction with the accompanying drawings, in which

FIGS. 3*a* and 3*b* are cross-sectional views of two embodiments of the yarn feeding inlet portion of the nozzle;

FIG. 4 is a fragmentary top plan view of the embodiment shown in FIG. 2, with the jacket and movable other parts of the block removed;

FIG. 5 is a fragmentary sectional view taken substantially along the line 5—5 of FIG. 4.

Referring more particularly to the drawings, FIG. 1 illustrates a longitudinal sectional view of the nozzle inlet portion of the present invention, without an insulating jacket and without the stuffer box. The nozzle inlet portion includes a yarn passageway 1, through which the yarn (not shown) advances in direction 2. Yarn passageway 1 widens at shoulder 3 at which the relatively narrow entry portion of the yarn passageway changes to a relatively wide portion 4, which is followed by a tapered outlet area 5 serving as a diffuser, and which leads to a stuffer box 23 (note FIG. 4) where a yarn tangle is formed. At the shoulder 3, four fluid delivery internal ducts 6 open into the yarn passageway. The ducts 6 each extend between the four bores 6 which form an annular internal conduit which surrounds the yarn passageway when viewed in a plane perpendicular to the yarn passageway. Specifically, the bores 8 form a polygon which surrounds the yarn passageway. A supply duct 10 connects the annular conduit to a source of pressurized and heated treatment fluid, such as hot air or saturated steam.

FIG. 2 illustrates an embodiment which comprises a divisible double nozzle for advancing and texturizing two yarns. As illustrated, the lower nozzle is shown in an opened or threadup condition, and the upper nozzle is in a closed or operative condition. The double nozzle is made of a block which is rectangular in cross section, and as illustrated measures twice as long as wide. The block is divided along two mutually perpendicular planes 9 which extend coaxially along respective ones of the two passageways 1. Resulting therefrom is a central block part 12 in the form of a right angled isosceles triangle in cross section. The two external or outer nozzle parts 13 are each likewise a right-angled, isosceles triangle in cross section. Formed into the two nozzle parts 12, 13 by, for example, drilling, milling or countersinking are yarn passageways 1 as well as hinge bores 11, which form cylindrical groove halves in each contact surface. The groove halves define bores for receiving a rod so as to form a hinged connection. At least one of the edges of the separating surfaces located at hinge bore 11 has a slightly beveled edge or chamfer 14 measuring for example, 10°-20°, so that the outer part 13 can be pivotally opened a corresponding angle.

Figure 1:
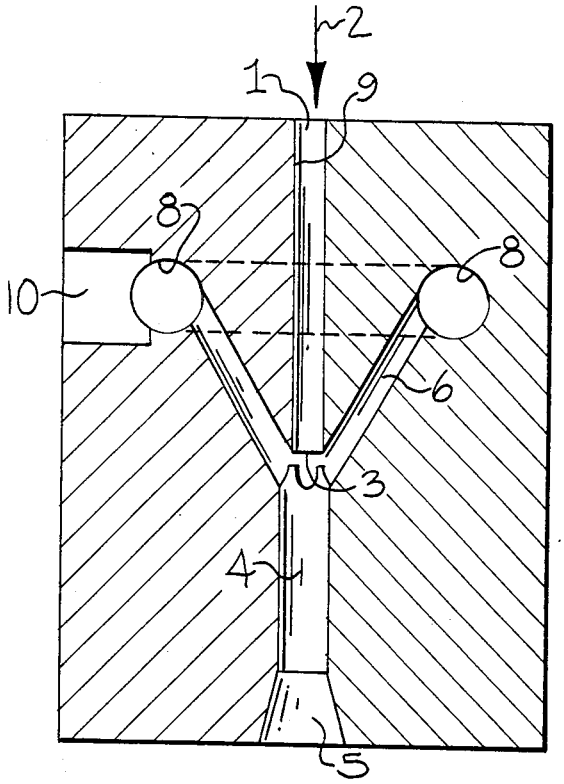
FIG. 1 is a longitudinal section view of a yarn feeding inlet portion of a texturizing nozzle in accordance with the features of the present invention.

Formed into the outer nozzle parts 13 and central nozzle part 12 are two blind end bores 8 each on both sides of yarn passageway 1, and which lie in a plane perpendicular to the yarn passageway. Each bore 8 forms an acute angle with the separating plane of 45°, so that the internal ends of the bores meet. These bores form an annular internal conduit for each of the nozzles, which surrounds the yarn passageway 1. Each annular conduit is connected to a supply duct 10 for the treatment fluid.

Figure 2:
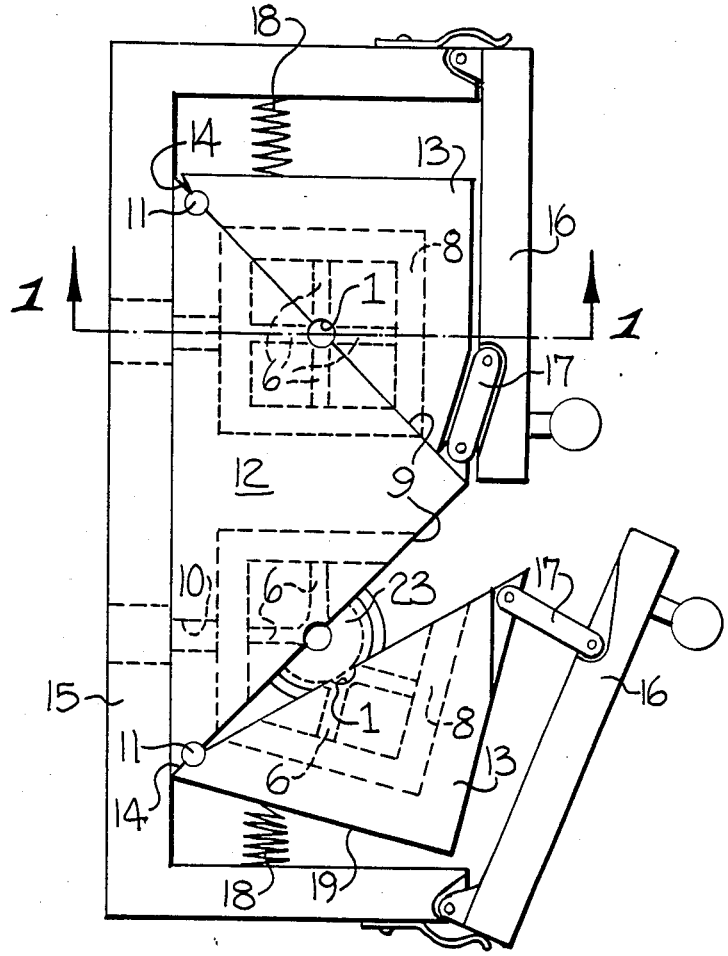
FIG. 2 is a side elevation view of an embodiment of the present invention comprising two nozzles.

Four individual ducts 6 are provided, which communicate at each end with the bores 8 forming the annular conduit, and communicate at the other end with the yarn passageway. These ducts 6 are each located on the surface of an acute-angled cone and are each offset by 90° from each other as seen in FIG. 2. In operation, the outer parts 13 of the nozzles are placed against the central nozzle part 12, and springs 18 press the nozzle parts against each other. The beveled edge 14 provided on the edge of each separating surface of the outer nozzle parts 13 located at hinge bore 11 assures that each nozzle can be opened at a slight angle which corresponds to the angle of the chamfer. The double nozzle is surrounded by an insulating jacket 15, which is preferably heated and provided with a door 16 on the front side for each nozzle. A closing lever 17 connects each door 16 with its respective outer nozzle part 13, so that each nozzle may be opened and closed simultaneously with the door of the insulating jacket. Springs 18 support the outer nozzle parts 13 between the insulating jacket and their outside surface 19. Two advancing yarns can thus be inserted laterally with respect to their direction of advance into each yarn passageway without having to be cut or drawn in by suction, and with the yarns being separated by the central nozzle part 12. The central nozzle part possesses either a central or, as shown, two separate connections 10 to supply the treatment fluid to the annular conduits.

Special features may be provided to prevent the treatment fluid from freely escaping when the nozzles are opened at the separating planes 9, to insert the yarn, and to ensure that the opened nozzle can be serviced, for example, cleared of waste yarn, without being a hazard for the operating personnel. To this end, there is preferably arranged in supply duct 10 for the treatment fluid a cutoff device (not shown) which is adapted to be automatically actuated as a function of a sensor which determines a pressure drop in the annular interior conduit. A bypass line may also be opened to a pressure reducer, through which a certain, small amount of the fluid may leave at annular conduit under controlled conditions, which amount is sufficient to prevent the air texturing nozzle from cooling to a significant extent. Also provided within the framework of the present invention is an arrangement wherein the cutoff means for the treatment fluid in supply duct 10 is operably connected with the locking and the unlocking mechanism of a door 16 to the insulating jacket 15, such as by actuating a limit switch, which reverses a controlling element for the cutoff means, such as a multiway valve leading to a bypass line having a pressure reducer.

FIGS. 3*a* and 3*b* are cross-sectional views of nozzle inlet portions which substantially correspond to those of FIGS. 1–2, but wherein the annular interior conduits are somewhat differently formed. In these embodiments of the nozzle, the annular interior conduit includes two blind bores 20 formed in each of the two parts of the nozzle block, with the bores 20 extending from the separating plane 9 on opposite sides of the yarn passageway, either at an acute angle (FIG. 3*a*) or at a right angle (FIG. 3*b*). Also, the ends of the bores 20 which extend from separating plate 9 communicate with each other at the separating plane in the manner illustrated. To this end, the nozzle block is first divided along the separating plane 9, and then the yarn passageway 1 is formed in the two parts, for example, by milling. Subsequently, the bores 20 are formed, and a connecting bore 21 is formed in each part, with the bores 21 extending parallel to the separating plane 9 and interconnect the individual bores 20. The outer ends of the two connecting bores 21 are closed with a screw cap 22.

Four internal ducts 6 are provided which extend from the annular conduit to the yarn passageway 1. In FIGS. 3*a*–3*b*, the ducts 6 join the annular conduit at the point where the individual bores 20, 21 forming the annular conduit meet. Also, the nozzle is provided with a central connection 10 for the entry of the treatment fluid.

FIG. 4 shows the air texturing apparatus of FIG. 2 with the insulating jacket 15 and the outer nozzle part 13 being omitted. Specifically, the right-hand portion of the central nozzle part 12 as seen in FIG. 2 is illustrated, together with the stuffer box 23 which is mounted on the stationary nozzle half 12. Also illustrated is a profiled roll of the feed mechanism 24 for withdrawing the yarn plug formed in the stuffer box.

The stuffer box 23 is designed as a slotted tube and has in its upstream and central portions of the side wall of the tube longitudinal slots 25 or perforations distributed over its circumference, through which the treatment fluid can exhaust. In the exit area, slots 25 are covered by an annular sleeve 26 with a flange-shaped stop 27, which prevents the filaments of the yarn plug from adhering to the walls of the slotted tube. As to further details of stuffer box 23, reference is made to the detailed description found in German utility model No. 7,723,587.

The stuffer box 23 has a yarn insertion slot 28 cut through the side wall and which extends over the entire length of the stuffer box 23, including the sleeve 26 which is inserted at its outlet end. The yarn insertion slot 28 as well as the axis of the stuffer box are preferably arranged in such a way that they lie in the separating plane 9 of the yarn feeding inlet portion of the nozzle. The alignment of the yarn inserting slot 28 with the separating plane 9 serves to facilitate the threading of the yarn into the stuffer box. In particular, it will be understood that the doors 16 of the heating jacket 15 should be opened only a relatively small angle so as to avoid undue heat loss during threadup, note FIG. 2. With the slot 28 aligned with the plane 9, it is possible to slide the yarn laterally into the relatively narrow opening between the parts 12 and 13, and along the surface of central part 12 which is defined by the plane 9, and so that the yarn slides directly and easily into the slot 28.

The stuffer box 23 is preferably fixed only to the stationary central nozzle part 12. Therefore, the outer nozzle part, which is not shown in FIG. 4, can be opened and closed and is movable with respect to the stuffer box. In addition, that portion of the stuffer box side wall which is overlapped by the movable external nozzle part 13 is movable in such a way that the insertion slot 28 can be opened and closed. Specifically, to close yarn insertion slot 28 of the stuffer box 23, suitable pressure means are provided and distributed over the length of the stuffer box 23. This pressure means exerts a force which is perpendicular to the separating plane 9 of the nozzle, and thus also perpendicular to the plane of the slot 28, and which acts to radially compress the flexible slotted tube. Such pressure applying means may consist of mechanical screws, or as is shown in FIG. 5, it may consist of cylinder-piston-units 29 which are supported on the machine frame. The side wall of the stuffer box may have additional radial slots extending in a lengthwise direction for increasing its flexibility. Also, a support 30 is provided which serves to exert a counter-force to the force of the pressure applying means 29. When cylinder-piston-unit 29 is released, the side wall of the slotted tube and sleeve 27 recovers and returns to its normal position, thereby opening the yarn insertion slot 28 for the carrying out of the yarn threadup operation.

It will be understood that the double nozzle as shown in FIG. 2 has a second stuffer box 23 in alignment with the second yarn passageway 1. This second stuffer box is arranged such that its yarn insertion slot is in alignment with the separating plane 9 of the other nozzle, and thus the yarn insertion slots of the two stuffer boxes enclose an angle of 90°.

Figure 6:
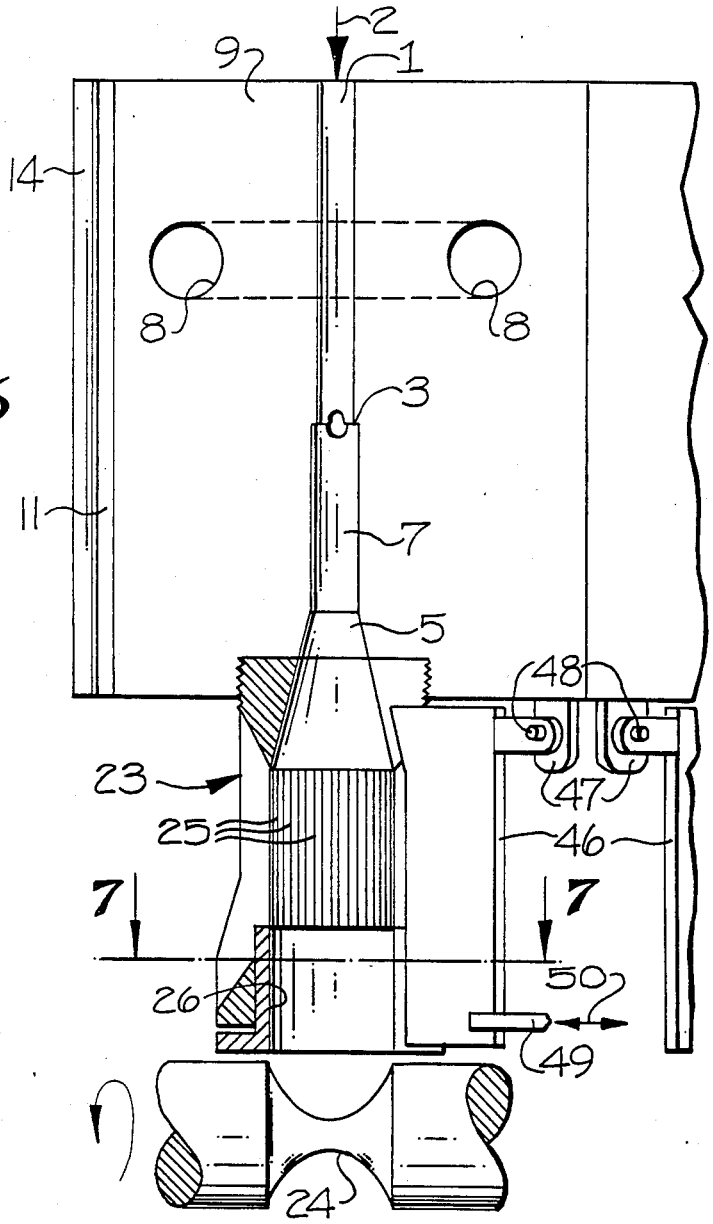
FIGS. 6 and 7 are similar to FIGS. 4 and 5 respectively, but illustrating a further embodiment of the invention.
Figure 7:
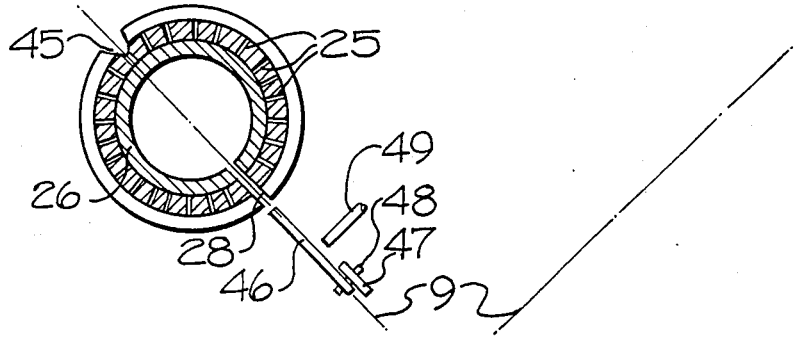

The air texturing nozzle of FIGS. 6 and 7 substantially corresponds to that shown in FIGS. 4 and 5. The inlet portion is identical to that one shown in FIG. 4, and the description of the inlet portion relating to FIG. 4 also applies to the inlet portion as shown in FIG. 6.

The stuffer box 23 of FIGS. 6 and 7 also corresponds to the one shown and described with respect to FIGS. 4 and 5. However, for closing the yarn insertion slot 28 of the stuffer box 23 as shown in FIGS. 6 and 7, a flat metal plate 46 is provided. The width of this plate of metal corresponds to the width of the slot in such a way that the escape of air is permitted in the same way as through longitudinal slots 25, and the plate can be easily inserted into and removed from the slot. The length of the plate corresponds to the length of the stuffer box 23.

Suitable means are provided to movably mount the plate 46 for selective movement into and away from the slot 28. This mounting means includes a support 47 mounted to the central part 12 of the nozzle block, with the support 47 positioned immediately adjacent and parallel to the separating plane 9. The plate 46 is pivotally mounted to the support 47 by means of a pin 48, and such that the plate 46 pivots in the separating plane 9 and the plane of the yarn inserting slot 28 to permit the plate 46 to move into and away from the slot 28. The plate 46 may be held in its position within the slot 28 by a movable locking bolt 49, which is movable along the back side of the plate 46 in the direction indicated by arrow 50 and which is perpendicular to the plane 9. For bringing the plate 46 to its inoperative position, which is shown in FIG. 7, the bolt 49 can be moved out of the way. On the other hand, the operative position is fixed by the plate abutting on the outer surface of the inlet portion.

In the drawings and specification, there have been set forth preferred embodiments of the invention, and although specific terms are employed, they are used in a generic and descriptive sense only and not for purposes of limitation.

That which we claim is:

1. A yarn texturing nozzle comprising a yarn feeding inlet portion comprising a block having a yarn passageway extending therethrough and defining an inlet end and outlet end, and with said block being divided into two parts along a plane extending axially along the passageway so that the two parts may be separated along said plane to facilitate yarn threadup, and with said block further including at least one internal duct communicating with said passageway and being inclined with respect to the axis of said passageway so as to be directed toward said outlet end, and conduit means for connecting said at least one internal duct to a source of a pressurized treatment fluid and such that the pressurized fluid entering said passageway through said internal duct is adapted to advance a yarn through said passageway and toward said outlet end, and a tubular stuffer box mounted to abut the outlet end of said block in coaxial communication with said outlet end of said passageway, said stuffer box including a peripheral side wall having opening means extending therethrough for permitting the treatment fluid to exhaust laterally through said side wall, and wherein said stuffer box further includes a yarn inserting slot extending through said side wall to facilitate yarn threadup, and means for selectively closing said yarn inserting slot.

2. The yarn texturing nozzle as defined in claim 1 wherein each of said parts of said block includes at least one internal duct, and wherein said conduit means includes an annular internal conduit surrounding said passageway in a plane transverse to the axis of said passageway, with said annular internal conduit communicating with each of said internal ducts and comprising a conduit segment within each of said two parts of said block and such that the two conduit segments communicate with each other across said separating plane.

3. The yarn texturing nozzle as defined in claim 2 wherein said internal ducts are equally inclined with respect to the axis of said passageway.

4. The yarn texturing nozzle as defined in claim 3 wherein each conduit segment within each of said two parts of said block comprises two straight passage bores which are perpendicular to each other and include outer ends which communicate with said separating plane, and inner ends which intersect within the interior of the associated block part.

5. The yarn texturing nozzle as defined in claim 4 wherein said block is substantially rectangular in cross section, and said separating plane extends along a line defining a right angled isosceles triangle with two sides of the rectangular block in cross section.

6. The yarn texturing nozzle as defined in claim 3 wherein each conduit segment within each of said two parts of said block comprises a first passage bore within the interior of the associated part and which extends parallel to said separating plane, and a pair of second passage bores extending between said separating plane and said first passage bore.

7. The yarn texturing nozzle as defined in claim 3 wherein said passageway through said block includes a first portion adjacent said inlet end and a second portion adjacent said outlet end, with said second portion having a larger diameter than said first portion so as to define a shoulder at the juncture thereof.

8. The yarn texturing nozzle as defined in claim 7 wherein each of said internal ducts communicates with said passageway at said shoulder.

9. The yarn texturing nozzle as defined in claim 3 wherein said yarn inserting slot of said stuffer box is positioned in alignment with said separating plane.

10. The yarn texturing nozzle as defined in claim 3 wherein said block further includes hinge means for pivotally interconnecting said two parts of said block.

11. The yarn texturing nozzle as defined in claim 10 wherein said hinge means comprises opposing parallel grooves formed in each of said parts along said separating plane to define a bore extending substantially parallel to said yarn passageway, and a rod mounted within said bore formed by said parallel grooves so that said parts pivot about the axis of said rod.

12. The yarn texturing nozzle as defined in claim 11 wherein said hinge means further comprises a chamfer extending along one side of at least one of said parallel grooves and so as to provide clearance for said pivotal movement.

13. A yarn texturing nozzle as defined in claim 3 further comprising a heat insulating jacket which effectively encloses said block, and door means for selectively opening said jacket to provide access to said block for yarn threadup.

14. The yarn texturing nozzle as defined in claim 13 further comprising means interposed between said insulating jacket and said block for biasing said two parts of said block into contact with each other along said separating plane.

15. The yarn texturing nozzle as defined in claim 1 wherein said means for selectively closing said yarn inserting slot of said stuffer box comprises means for biasing said side wall in a direction perpendicular to said separating plane so as to deform the side wall and close said slot.

16. The yarn texturing nozzle as defined in claim 1 wherein said means for selectively closing said yarn inserting slot of said stuffer box comprises a plate movably mounted for selective movement into and away from said slot.

17. A yarn texturing nozzle comprising a yarn feeding inlet portion comprising a block of rectangular cross section, said block having a pair of parallel yarn passageways extending therethrough and defining an inlet end and an outlet end, and with said block being divided along two separating planes which extend coaxially along respective ones of the passageways to thereby form three block parts, and including a central part and two outer parts, and means mounting each of said outer parts to said central part to permit each of the outer parts to be separated from said central part along the associated separating plane to facilitate yarn threadup, and with said block further including an internal duct communicating with each of said passageways and being inclined with respect to the axis of the associated passageway so as to be directed toward said outlet end, and conduit means for connecting each of said internal ducts to a source of a pressurized treatment fluid and such that the pressurized fluid entering each passageway through its associated internal duct acts to feed a yarn through such passageway and toward said outlet end, and a tubular stuffer box mounted to abut the outlet end of each of said passageways and so as to coaxially communicate therewith, with each stuffer box including a peripheral side wall having opening means extending therethrough for permitting the treatment fluid to exhaust laterally through said side wall, and wherein each stuffer box further includes a yarn inserting slot extending through said side wall to facilitate yarn threadup, and means for selectively closing said yarn inserting slot.

18. The yarn texturing nozzle as defined in claim 17 wherein said yarn inserting slot of each stuffer box is aligned with the associated separating plane.

19. The yarn texturing nozzle as defined in claim 18 wherein said two separating planes are mutually perpendicular to each other and such that each of said three block parts are triangular in cross section.

20. The yarn texturing nozzle as defined in claim 19 wherein said inlet portion further includes hinge means for pivotally interconnecting each of said outer parts of said block to said central part along the associated separating plane.

21. The yarn texturing nozzle as defined in claim 20 further comprising a heat insulating jacket which effectively encloses said block, and wherein said jacket includes a fixed portion and a pair of doors which are pivotally mounted to said fixed portion so as to provide access to selective ones of said separating planes so as to permit yarn threadup to each passageway.

22. The yarn texturing nozzle as defined in claim 21 wherein said nozzle further includes means operatively interconnecting each of said doors to an associated outer part of said block so that each door and its associated outer part concurrently pivot to facilitate yarn threadup.

* * * * *